US005471699A

United States Patent [19]

Shaw

[11] Patent Number: 5,471,699

[45] Date of Patent: Dec. 5, 1995

[54] BROOM HEAD HOLDER FOR ATTACHING TO A BROOM HEAD

[75] Inventor: Raymond R. Shaw, Oak Park, Mich.

[73] Assignee: Barry Hirsch, Farmington, Mich.

[21] Appl. No.: 236,323

[22] Filed: Apr. 29, 1994

Related U.S. Application Data

[60] Division of Ser. No. 864,324, Apr. 6, 1992, Pat. No. 5,319,822, which is a continuation-in-part of Ser. No. 729,630, Jul. 15, 1991, abandoned.

[51] Int. Cl.[6] ..... A46B 17/02

[52] U.S. Cl. ..... 15/146; 15/178

[58] Field of Search ..... 15/146, 147.1, 15/150, 152, 154, 176.6, 178, 228

[56] References Cited

U.S. PATENT DOCUMENTS

| | | | |
|---|---|---|---|
| 1,967,406 | 7/1934 | Hicks | 15/150 |
| 2,059,662 | 11/1936 | Smith | 15/150 |
| 2,299,810 | 10/1942 | Fatland | 15/146 |
| 3,813,724 | 6/1974 | Unger | 15/150 |
| 4,499,626 | 2/1985 | Schneider | 15/146 |

FOREIGN PATENT DOCUMENTS

| | | | |
|---|---|---|---|
| 1131276 | 10/1956 | France | 15/146 |
| 97019 | 4/1898 | Germany | 15/146 |
| 332676 | 2/1921 | Germany | 15/146 |
| 501604 | 7/1930 | Germany | 15/146 |
| 568427 | 1/1933 | Germany | 15/146 |
| 41082 | 3/1925 | Norway | 15/146 |
| 75019 | 5/1949 | Norway | 15/146 |
| 35910 | 12/1913 | Sweden | 15/146 |
| 61656 | 8/1912 | Switzerland | 15/146 |
| 74925 | 12/1916 | Switzerland | 15/146 |
| 197211 | 5/1923 | United Kingdom | 15/146 |

*Primary Examiner*—David A. Scherbel
*Assistant Examiner*—Tony G. Soohoo
*Attorney, Agent, or Firm*—Gifford, Krass, Groh, Sprinkle, Patmore, Anderson & Citkowski

[57] ABSTRACT

A broom head holder with a receptacle for a handle. A broom head is clamped into a C-shaped broom head holder portion. A first variation of the broom head holder has a spring clamp attached to an over center lever to hold the broom head in the C-shaped broom head holder. A second embodiment of the broom head holder has a C-shaped member which engages the top, a first side surface and a first bottom lip of the broom head. A second holding member engages an opposite side of the broom head. Threaded fasteners connect the C-shaped members to the second holding member to secure the second holding member against an opposing edge and against a bottom opposite edge of a broom head.

1 Claim, 3 Drawing Sheets

BROOM HEAD HOLDER FOR ATTACHING TO A BROOM HEAD

This is a divisional of application Ser. No. 7/876,324 filed on Apr. 6, 1992, U.S. Pat. No 5,319,822 which is a continuation-in-part of application Ser. No. 07/729,630, filed Jul. 15, 1991, now abandoned for a BROOM HEAD HOLDER.

BACKGROUND OF THE INVENTION

I. Field of the Invention

This invention relates to holding of broom heads in a broom head holder and more particularly to a broom head holder adapted to clamp the broom head to the broom head holder.

II. Description of the Prior Art

In the use of brooms, especially push brooms. it has long been known to use a threaded broom handle which lockingly engages threads on the broom head. An undesirable result occurs when the threads in the broom head become loose or broken resulting in a broom head that is essentially unusable. It is desirable from a cost and utility viewpoint to maximize the use of existing broom heads. When the threads are broken in the broom head, the broom head is usually thrown away with many good bristles still remaining. U.S. Pat. No. 4,882,802 to Levere, Jr. discloses replaceable broom fiber strips mounted to a broom head.

Non-movable objects are often encountered during use of a push broom. There are many prior known means attempting to keep the broom handle from snapping off when encountering such non-movable objects. U.S. Pat. No. 3,340,556 to Allen teaches a broom head having an upper resilient portion. U.S. Pat. No. 4,785,489 to Von Doehren discusses a resilient broom and scraper having a bracket rigidly secured to the broom block. Resilient means in a broom shroud is taught in U.S. Pat. No. 4,642,837 to Nichols et al. A broom handle torque brace is shown in U.S. Pat. No. 3,239,280 to Fielder, Jr. An adjustment to pivot a broom head is disclosed in U.S. Pat. No. 4,901,392 to Shapiro et al.

Accordingly, prior inventions have failed to eliminate the problems commonly associated with connecting a broom head containing bristles to a handle after the threads in the broom head are no longer usable.

An improved arrangement for holding a broom head has been described in my co-pending application Ser. No. 07/729,630 filed Jul. 15, 1991.

The object of the present invention is to provide a broom head holder having the following advantages: it can use various broom heads, including those with defective threads; it eliminates threaded engagement to the handle; and it is attached to the broom head by clamping onto the broom head.

SUMMARY OF THE PRESENT INVENTION

The present invention provides a broom head holder for replaceable broom heads. The broom head holder, according to the present invention, overcomes the above-mentioned disadvantages of the previously known broom head attachment methods, thus providing the advantage of extending the useful life of brooms.

As set forth in the parent patent application Ser. No. 07/729,630 filed on Jul. 15, 1991, the broom head holder comprises a broom head holder into which a conventional broom head having bristles is received. The broom head holder is sized to fit standard broom heads. A lip for the broom head to sit on and means for gripping the conventional broom head are included on the inside of the broom head holder.

End caps can be added to the ends of the broom head holder to prevent the broom head from dislodging laterally from the broom head holder. The broom head holder can be made from a high density rigid material having a predetermined degree of elasticity. This material will allow the broom head holder to form around the broom head yet also hold the broom head. The broom head holder has a broom handle molded in one piece to the head holder thereby alleviating the problem of the threaded engagement of the prior invention.

A variation of the broom head holder has a planar member which is either strapped or screwed to a broom head. Yet another embodiment of the invention provides yoke arms between the broom head holder and the handle which have resilient portions. Resilient means may also be provided in the handle This latter resilient means may be a spring or a compressible plastic that allows for one end of the broom to engage a stationary object and deflect without stressing the handle.

The embodiments of the broom head holder of the present invention each use a clamp to attach the holder to the broom head Any of the variations discussed above may be conveniently used to recycle and extend the use of previously unusable broom heads to their complete term of useful life.

One embodiment designated as the domestic model, uses a clamp having a lever and a spring member to clamp the holder to the broom head. The second embodiment referred to as the industrial model uses a clamp having means for tightening a bracket around a broom head. The means for tightening are screws threaded into and tightened against receiving nuts.

BRIEF DESCRIPTION OF THE DRAWINGS

A better understanding of the present invention will be achieved upon reference to the following detailed description when read in conjunction with the accompanying drawings, wherein like reference characters refer to like parts and in which.

DETAILED DESCRIPTION OF THE INVENTION AND PREFERRED EMBODIMENTS THEREOF

The drawings disclose a preferred embodiment of the present invention.

Figure 1:
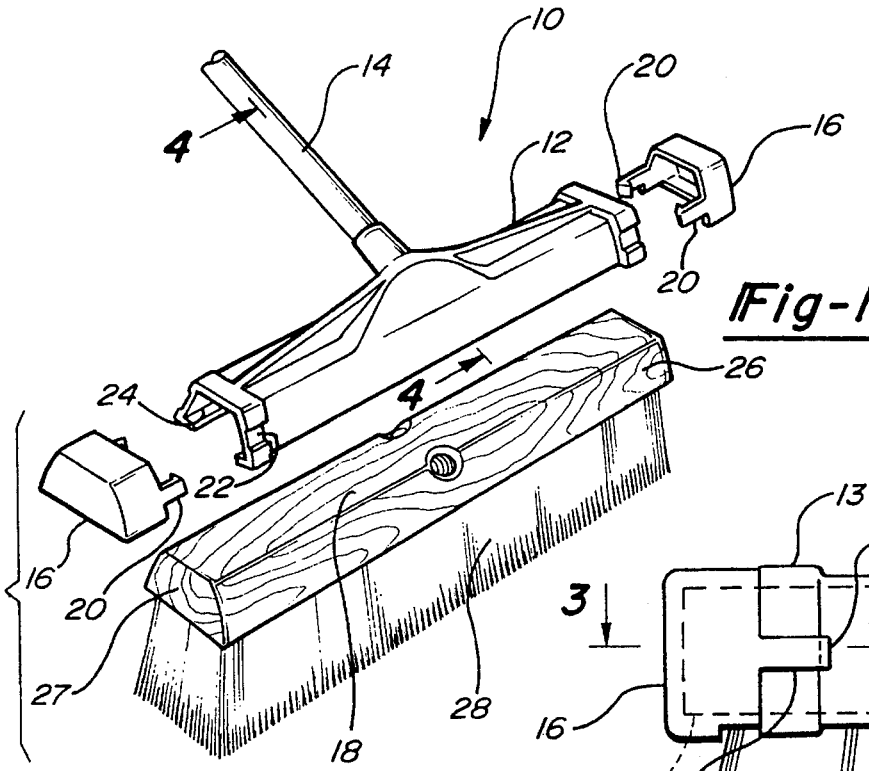
FIG. 1 is an exploded view of a broom head holder of the present invention.

With reference first to FIG. 1, a preferred embodiment of the broom head holder 10 according to the present invention is shown. A first embodiment of the broom head holder 10 is composed of a holder 12 formed integrally to a handle 14 having end caps 16. A broom 18 having a broom head 26 and bristles 28 is shown in FIG. 1. An end 27 of the broom 18 is slidingly inserted into and is receivable into the holder 12. End caps 16 prevent the broom head 26 from laterally moving out of the holder 12.

Figure 2:
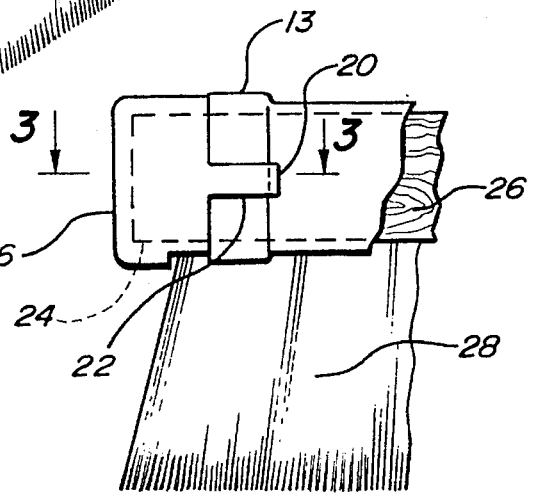
FIG. 2 is a side view of an end cap of the broom head holder.
Figure 3:
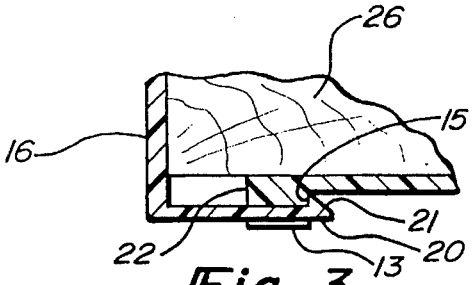
FIG. 3 is a sectional view along section 3—3 of FIG. 2.

FIGS. 2 and 3 show the details of the attachment of the broom 18 to the broom head holder 10. The broom head 26 of the broom 18 slides into the holder 12 and rests on lips 24 provided on the inside of the holder 12. The end caps 16 are then attached to the ends of the holder 12 and lock the broom head 26 therein. The end caps 16 as more clearly shown in FIG. 1, each have a pair of tangs 20 on opposite sides thereof. The tangs 20 are received in a tang slot 22 provided in the holder 12 and lock the end caps 16 to the holder 12 captivating the broom head 26 of the broom 18 in the holder 12

FIG. 3 is a sectional view showing the locking of the end cap 16 to the end of the holder 12. The holder 12 has an attachment shoulder 13 in which the tang slot 22 is formed. The inside edge of the tang slot 22 forms a dog catch 15 which is engaged by a dog 21 provided on the end of the tang 20 as shown to lock the end cap 16 to the head 12.

Figure 4:
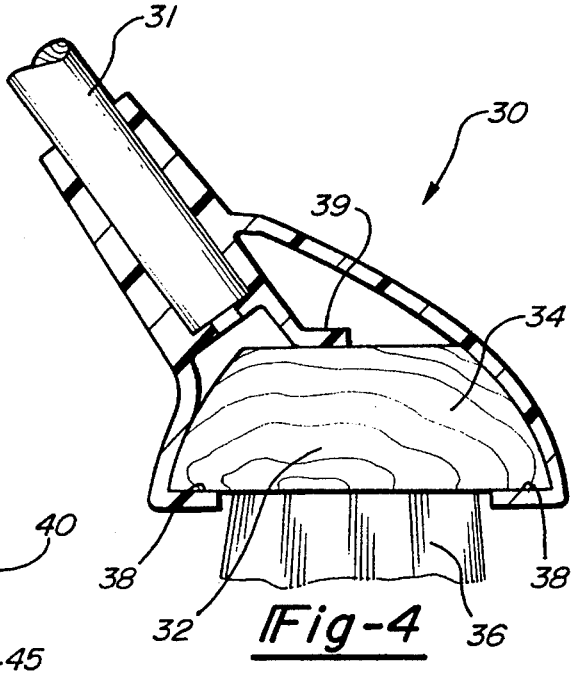
FIG. 4 is a sectional view along section 4—4 of FIG. 1.

FIG. 4 shows a second embodiment of the broom head holder 30 of the present invention. This second embodiment of the broom head holder 30 has a handle 31 and inwardly projecting lips 38 and is designed to hold a broom 32 having a broom head 34 and bristles 36. The broom head 34 is received into the broom head holder 30 so that the broom head 34 rests upon the lips 38. An internal foot 39 resiliently engages the top of the broom head and biases it against the lips 38. End caps (not shown) can be added to the second embodiment of the broom head holder 30.

Figure 5:
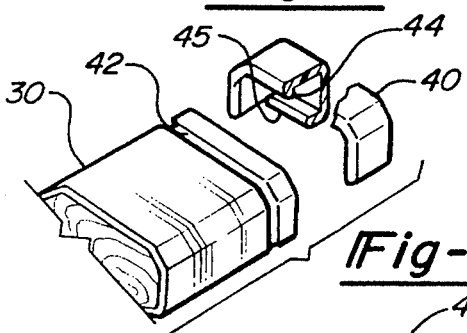
FIG. 5 is an exploded view of a variation of an end cap.
Figure 6:
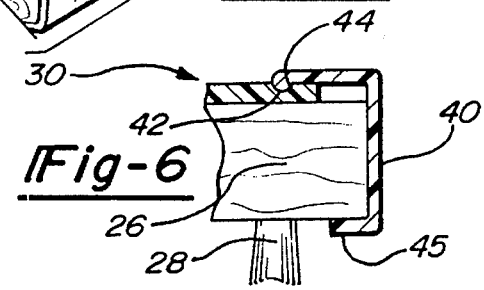
FIG. 6 is a sectional view of the cap of FIG. 5.

An alternate embodiment of the end caps 40 is shown in FIGS. 5 and 6 The alternate embodiment of the end cap 40 has an internal bead 44 provided along its inner edge which snaps into a groove 42 provided in the external surface of a broom head holder 30 and a bottom locking tab 45 which engages the bottom edge of the broom head 26, as shown in FIG. 6, to maintain the internal bead 44 in the groove 42. Broom head holder 30 is otherwise substantially the same as broom head holder 12.

FIG. 6 is a sectional view of the alternate embodiment of the end cap 40 attached to the end of the broom head holder 30. The internal bead 44 of the alternate embodiment of the end cap 40 snaps into the groove 42 of the broom head holder to lock the broom head 26 having bristles 28 in the holder 30.

Figure 7:
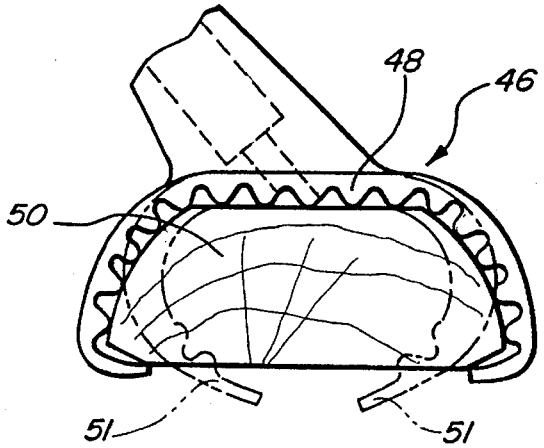
FIG. 7 is a side view of a broom head holder showing means for grasping a first type of broom head.

Referring now to FIG. 7, a third embodiment of the broom head holder 46 is shown. The broom head holder 46 is made of a strong yet flexible material such as rubber or plastic. Means for gripping, such as ribs 48, are located along the internal surface of the broom head holder 46. Phantom lines 51 show the configuration of the broom head holder 46 without a broom head 50 contained therein. The broom head 50 is shown inserted into and deforming the broom head holder 46.

Figure 8:
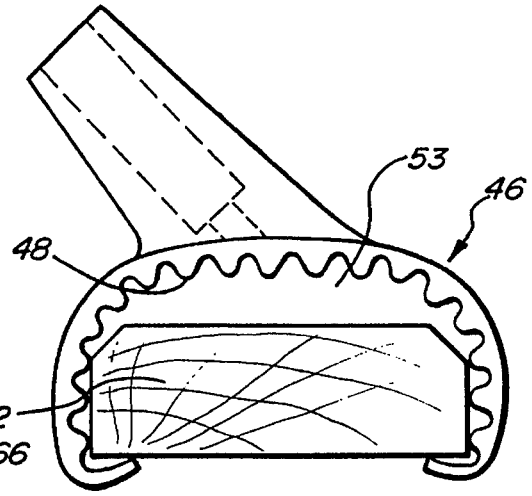
FIG. 8 is a side view of a broom head holder grasping a second type broom head.

FIG. 8 shows the broom head holder 46 with a broom head 52 having a smaller height profile leaving a space 53 between the top surface of the broom head 52 and the broom head holder 46.

Figure 9:
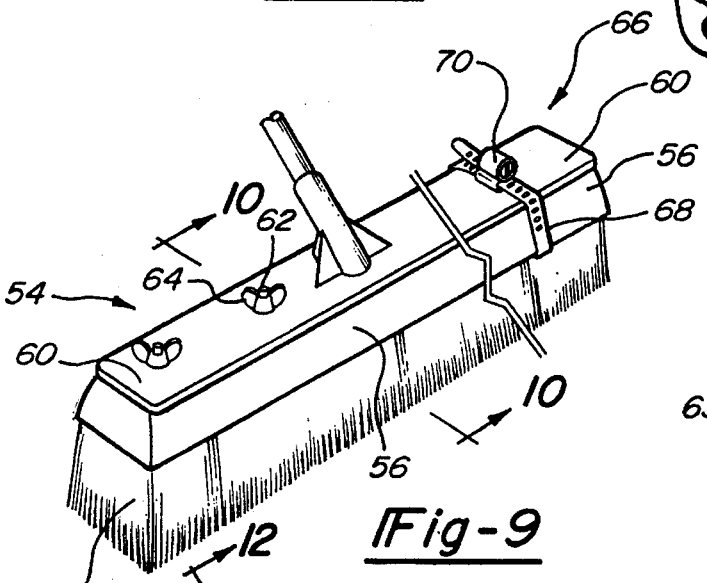
FIG. 9 is a perspective view of an alternate embodiment of a broom head holder using a planar attachment member.

FIG. 9 shows a fourth embodiment of broom head holder 54 having a planar member 60. The planar member 60 is locked to the broom head 56 by wing nuts 64 threaded onto threaded studs 62. The threaded studs 62 have a wood screw threaded portion 63 (shown in FIG. 10) screwed into the top surface of the broom head 56. The planar member 60 has openings 63 through which the threaded studs protrude. The wing nut is threaded onto the protruding end of the stud 62 to lock the planar member 60 against the top surface of broom head 56.

The broken out section of FIG. 9 shows a variation of the broom head holder 54. This variation uses strapping 68 around the planar member 60 and engaging the bottom edges of the broom head 56. A conventional strap advancement mechanism 70 is used to tighten the strapping 68. This will secure the planar member 60 to the top surface of the broom head 56

Figure 10:
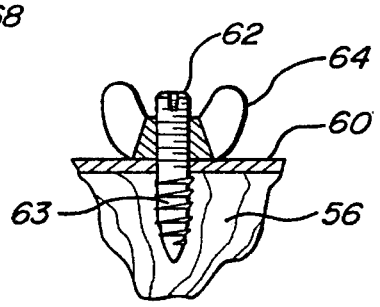
FIG. 10 is a sectional view of the broom head holder of FIG. 9 taken along section lines 10—10.

A cross-section of the fourth embodiment of the broom head holder 54 is shown in FIG. 10. As shown in FIG. 10, the wood screw threaded portion 63 of stud 62 is threaded into the top surface of the broom head 56, the planar member 60 is received over the protruding portion of the stud 62, and the wing nut 64 is threaded onto stud 62 to lock the planar member 60 to the top surface of the broom head 56.

Figure 11:
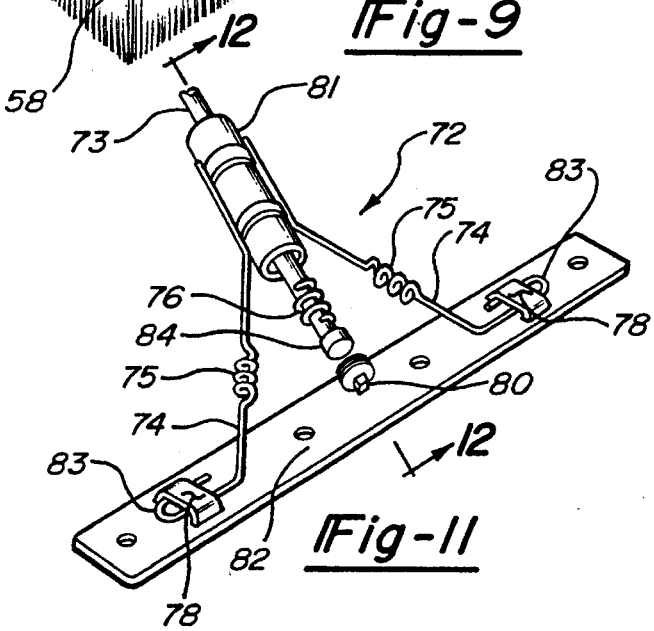
FIG. 11 is a perspective view of a broom head holder of FIG. 8 with resilient means.
Figure 12:
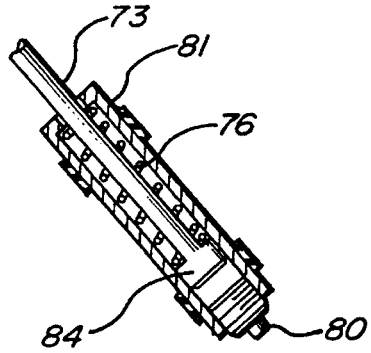
FIG. 12 is a sectional view of the broom head holder of FIG. 11 taken along section lines 12—12.

A fifth embodiment of a broom head holder 72 having resiliency is shown in FIGS. 11 and 12. The handle 73 is received in a cylindrical housing 81 having a resilient member 76 biasing the handle 73 towards the forward end thereof. The displacement of the handle 73 by the resilient means 76 is contained by and acts against an end plug 80 attached to the end of the cylindrical housing 81. Yoke arms 74 extend from the cylindrical housing 81. The yoke arms 74 have coiled sections 75 which provide for a degree of resiliency of the yoke arms 74. The other end of each yoke arm 74 is attached to a planar member 82 by means of a "U" shaped foot 83 received in an upraised yoke attachment catch 78.

FIG. 12 shows a cross-section of the handle and resilient means as indicated by lines 12—12 in FIG. 11. The handle 73 is received in the cylindrical housing 81 and is surrounded by a resilient means such as a coil spring 76 disposed between one end of the cylindrical housing 81 and a radial flange 84 provided at the end of the broom handle 73. The movement of the radial flange 84 towards the plate 60 is limited by the end plug 80.

Figure 13:
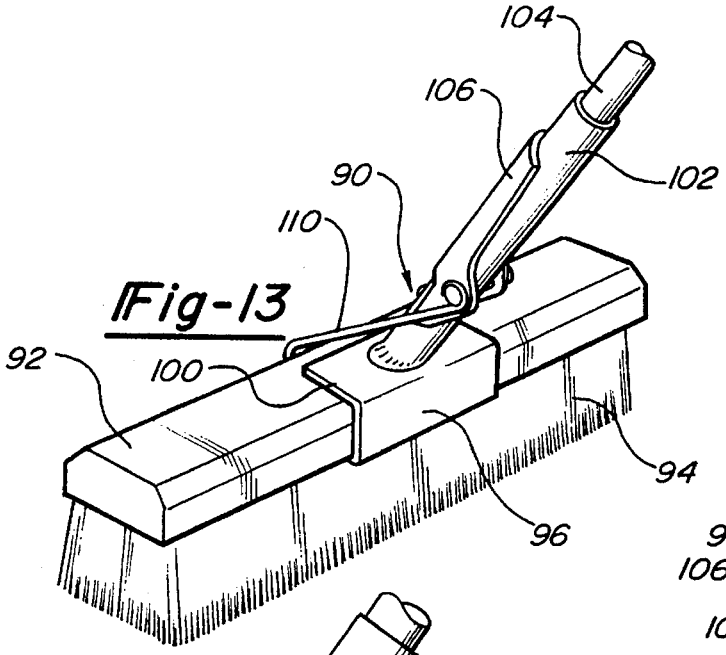
FIG. 13 is a perspective view of a domestic model of a broom head holder using a spring clamp.

In the embodiment of FIG. 13, the broom head holder 90 has a C-shaped member 96 having a lower portion 98, an upper portion 100 and a connecting portion 99. One side of the broom head 92 is received in the open side of the C-shaped member 96. As seen from FIGS. 13–15, the broom head 92 has a first side, second side, top and bottom. The upper portion 100 and connecting portion 99 are drawn into engagement with the top and first side of the broom head 92. The lower portion 98 of the C- shaped member is also drawn into engagement the bottom of the broom head in proximity to the first side of the broom head 92. The C-shaped member 96 has a receptacle 102 mounted to the upper portion 100 for receiving a broom handle 104 shown in FIG. 13. An over center lever 106 is attached at the point 108 to the handle receptacle 102 and is pivotable between an open and locked position. Spring member 110 is affixed to the over center lever 106 at an offset location which produces a force securing the over center lever in the locked position against the receptacle 102 when the spring member is engaged with the bottom of the broom head in proximity to the second side of the broom head.

Figure 15:
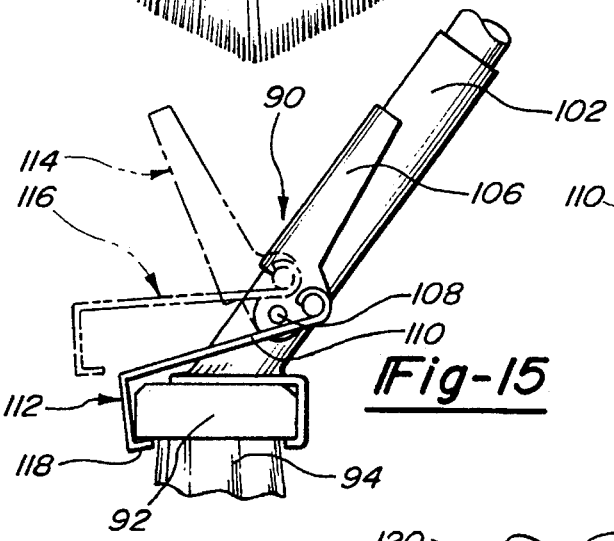
FIG. 15 is a side view of a domestic model of the broom head holder of FIGS. 13 and 14 showing the spring lever in a closed position and in phantom the spring lever in an open position.

FIG. 15 shows lever 106 in the locked position indicated by arrow 112 When the lever 106 is in the locked position against the handle receptacle 102, the spring member 110 resiliently engages the side of the broom head opposite the C-shaped member 96.

When the over center lever 106 is moved to an open position shown in phantom and indicated by arrow 114, the spring member 110 moves to a release position indicated by arrow 116 permitting the broom head 92 to be inserted into or removed from the C-shaped member 96. Spring member 110 has a turned edge 118 which lockingly engages an edge portion of the bottom surface of the broom head 92 in the locked position.

Figure 16:
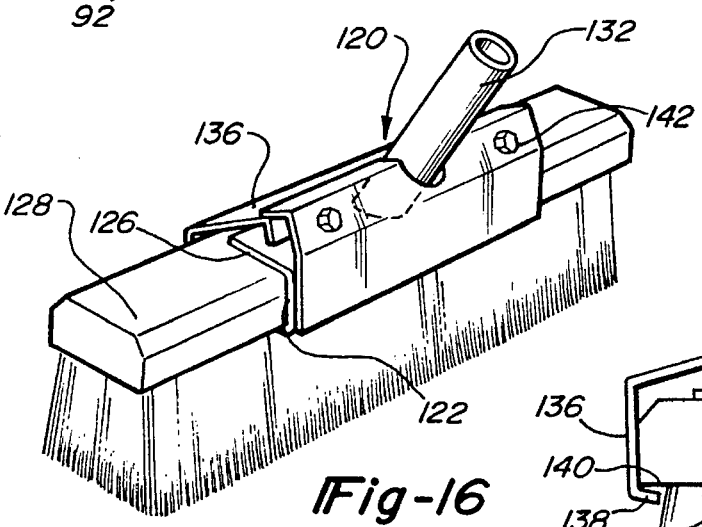
FIG. 16 is a perspective view of an industrial model of the broom head holder using a clamp.
Figure 17:
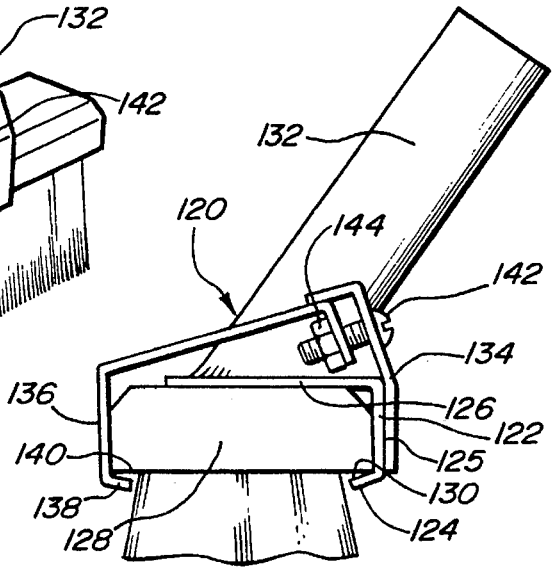
FIG. 17 is a side view of an industrial model of the broom head holder using a clamp of FIG. 16.

An embodiment of an industrial model 120 of a broom head holder is shown in FIG. 16. A C-shaped holding member 122 has an angled bottom portion 124 as best seen in FIG. 17, a top portion 126, and a connecting portion 125. The C-shaped holding member 122 fits around a broom head 128 with the angled bottom portion 124 of the C-shaped holding member 122 engaging a lower edge 130 of one side of the broom head 128. A handle receptacle 132 is attached to the C-shaped holding member 122. An angular flange 134 is fixably joined to the C-shaped holding member 122 by welding, riveting or any other means known in the art. Alternatively, the C-shaped holding member 122 and the annular flange 134 may be an integral extruded component.

A second holding member 136 has an angled bottom portion 138 which fits under the lower edge 140 of the broom head opposite the C-shaped holding member 122. Means for attaching, such as a screw 142, extend from the annular flange 134 through the second holding member 136. A nut 144 on the opposing side of the second holding member 136 allows the second holding member 136 to be clamped against the opposite edge of the broom head 128 holding it to the broom head holder 120. When the screw 142 is tightened into the nut 144, the angled bottom portion 138 on the second holding member 136 moves the broom head 128 against the top portion 126 along the angled bottom portion 124 of the C-shaped holding member 122 into position.

Figure 14:
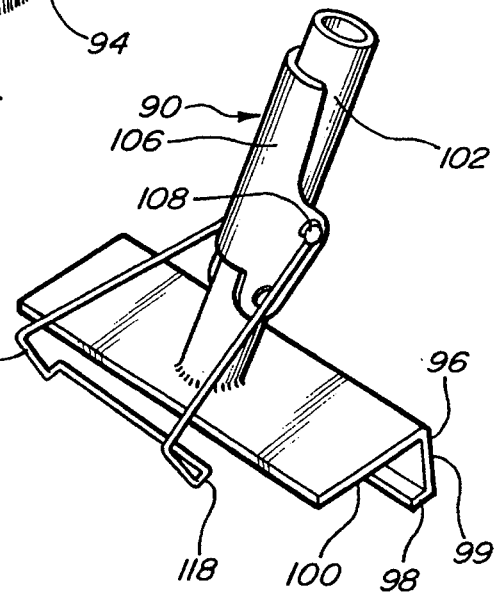
FIG. 14 is a perspective view of a domestic model of the broom head holder of FIG. 13 showing the front of the broom head holder.

The embodiments of FIGS. 13–17 by including a spring clamp as in FIGS. 13–15 and a threaded clamp as in FIGS. 16 and 17 permit secure holding of the broom head so that a broom head can be readily replaced but can be securely utilized when the broom head is held by one of the broom head holders 90 and 120.

Having described the invention, however, many modifications thereto will become apparent to those skilled in the art to which it pertains without deviation from the spirit of the invention as defined by the scope of the appended claims.

I claim:

1. An attachment device for use with a broom head, the broom head having a top, a bottom, a first side and a second side, said device comprising:

a substantially C-shaped holding member for attaching to the broom head, said holding member having a lower portion, an upper portion and a connecting portion separating said lower portion from said upper portion, said connecting portion and upper portion substantially engaging the first side and top of the broom head respectively when said holding member is attached to said broom head, said lower portion engaging the bottom of the broom head in proximity to the first side of said broom head when said holding member is attached to said broom head;

a cylindrical handle receptacle rigidly connected to said upper portion of said holding member for securely receiving a broom handle therein;

a lever pivotally secured to said handle receptacle, said lever being pivotable between a first unlocked position and a second locked position such that said lever lies against the handle receptacle when in the locked position; and a spring member pivotally attached to said lever and extending from said lever offset from said pivotal connection such that when said lever is in the locked position, an inwardly extending lip portion of said spring member is urged into resilient engagement with the bottom of the broom head in proximity to the second side of the broom head, the broom head thereby being engaged between said spring member, said upper portion and said connecting portion of said holding member, when said lever is in said unlocked position, said lip portion is removed from engagement with the bottom of the broom head.

* * * * *